US007690166B2

(12) United States Patent
Kagiyama et al.

(10) Patent No.: US 7,690,166 B2
(45) Date of Patent: Apr. 6, 2010

(54) WATERPROOF STRUCTURE OF BUILDING

(75) Inventors: Akihiro Kagiyama, Ibaraki (JP); Atsushi Iwase, Ibaraki (JP)

(73) Assignee: Sekisui Chemical Co., Ltd., Osaka (JP)

( * ) Notice: Subject to any disclaimer, the term of this patent is extended or adjusted under 35 U.S.C. 154(b) by 993 days.

(21) Appl. No.: 10/880,324

(22) Filed: Jun. 30, 2004

(65) Prior Publication Data

US 2005/0016102 A1 Jan. 27, 2005

(30) Foreign Application Priority Data

Jun. 30, 2003 (JP) ..... P.2003-188370
Nov. 20, 2003 (JP) ..... P.2003-391020

(51) Int. Cl.
*E04D 1/36* (2006.01)
*E04D 3/40* (2006.01)
*E04C 1/00* (2006.01)
*E04C 2/38* (2006.01)

(52) U.S. Cl. ..... 52/466; 52/60; 52/96; 52/309.16; 52/716.2

(58) Field of Classification Search ..... 52/11, 52/13, 58, 60, 95–97, 309.16, 716.2, 466, 52/43, 57
See application file for complete search history.

(56) References Cited

U.S. PATENT DOCUMENTS 1,963,583 A * 6/1934 Jenkins ..... 52/520
2,574,937 A * 11/1951 Sampson ..... 52/466
3,375,621 A * 4/1968 Curtis et al. ..... 52/58
4,271,651 A * 6/1981 Sorrells, Jr. ..... 52/460
4,400,924 A * 8/1983 Andrews ..... 52/466
4,586,301 A * 5/1986 Hickman ..... 52/96
4,590,730 A * 5/1986 Blendick ..... 52/461
5,272,849 A * 12/1993 Zahner, III ..... 52/466
5,423,157 A * 6/1995 Watanabe ..... 52/745.08
5,584,155 A * 12/1996 Watanabe ..... 52/538
6,164,021 A * 12/2000 Huber et al. ..... 52/43

FOREIGN PATENT DOCUMENTS

JP 58-190528 U 12/1983
JP 59-19717 U 2/1984
JP 62-49533 U 3/1987
JP 3-1943 A 1/1991
JP 04-285235 A 10/1992

(Continued)

OTHER PUBLICATIONS

Japanese Office Action issued in Application No. 2003-391020, dated Aug. 26, 2006.

*Primary Examiner*—Richard E Chilcot, Jr.
*Assistant Examiner*—Elizabeth A Plummer
(74) *Attorney, Agent, or Firm*—Sughrue Mion, PLLC

(57) ABSTRACT

A waterproof structure of a building, includes: at least two face members disposed on an exterior of the building; a sealing member disposed between end edge portions of the face members; a joint covering member disposed between the end edge portions. The end edge portions are folded to protrude exteriorly and have constrained portions for narrowing a gap therebetween. The sealing member is disposed between the end edge portions to close the gap between the end edge portions. The joint covering member covers and presses the sealing member from an exterior side. The joint covering member is attached to the constrained portions acting elastic force between the constrained portions.

10 Claims, 13 Drawing Sheets

FOREIGN PATENT DOCUMENTS

| | | | |
|---|---|---|---|
| JP | 6-306963 | A | 11/1994 |
| JP | 07-003953 | A | 1/1995 |
| JP | 7-34609 | A | 2/1995 |
| JP | 07-279393 | A | 10/1995 |
| JP | 2519660 | B2 | 5/1996 |
| JP | 08-232415 | A | 9/1996 |
| JP | 2001-140416 | A | 5/2001 |
| JP | 2001-295423 | A | 10/2001 |

* cited by examiner

WATERPROOF STRUCTURE OF BUILDING

BACKGROUND OF THE INVENTION

1. Field of the Invention

The present invention relates to a waterproof structure of a building using a cover member.

2. Background Art

Generally, an outside joint portion of a building of a roof, a balcony floor, an outer wall, a surrounding of an opening or the like is provided with a sealing member to constitute a waterproof structure.

A sealing member described in Japanese Patent No. 2519660 is arranged at inside of a joiner for connecting to engage roof sheets and constituted by forming a sealing member main body in an inverse U-like shape by an elastic material and forming a single or a plurality of fin-like sealing valves at positions on an inner side of the sealing member main body opposed thereto.

According to the above-described sealing member, the sealing valve squeezes the roof sheet members to eliminate a clearance therebetween to thereby prevent invasion of water.

Further, according to a folded sheet roof described in JP-A-7-34609, there is provided a waterproof structure of the folded sheet roof attaching a drip or the like to an attaching member installed above bulged shape head portions of contiguous ridge portions and an attaching apparatus constituted by integrally connecting a locking member fit to attach to constrained portions between valley portions interposed by the contiguous ridge portions and the attaching member.

According to the above-described waterproof structure of the folded sheet roof, the attaching apparatus is formed integrally therewith and therefore, fabrication cost can be reduced, there is not a concern of breaking joint between constituent members of the attaching apparatus even when a strong wind of typhoon or the like is brought about and the drip or the like can solidly be fixed to the folded sheet roof.

SUMMARY OF THE INVENTION

However, according to the sealing member described in Japanese Patent No. 2519660, there poses a problem that when the fin-like sealing valve is subjected to ageing deterioration, the sealing valve is opened by a reduction in an elastic force and water is liable to leak.

Further, according to the waterproof structure of the folded sheet roof described in JP-A-7-34609, when an interval between the bulged shape head portions of the contiguous ridge portions is widened, a volume of the attaching apparatus is increased to increase cost.

Hence, it is an object of the invention to provide a cover member and a waterproof structure of a building using a cover member which resolve the above-described problem, in which water is difficult to leak and which is highly reliable at low cost.

The invention provides a waterproof structure of a building, including: at least two face members each having an end edge portion, the at least two face members disposed on an exterior of the building so that the end edge portions are opposed to each other; a sealing member disposed between the end edge portions; and a joint covering member that is elastically deformable and disposed between the end edge portions; wherein the end edge portions are folded to protrude exteriorly and have constrained portions for narrowing a gap therebetween; the sealing member is disposed between the end edge portions to close the gap between the end edge portions; the joint covering member covers and presses the sealing member from an exterior side; and the joint covering member is attached to the constrained portions acting elastic force between the constrained portions.

Preferably, the waterproof structure further includes an anchor clip extending along the end edge portions; wherein the anchor clip is inserted into the gap being engaged with the end edge portions to be pressed and fitted on a backing member that is disposed on a back side of the face member.

Preferably, the waterproof structure further includes an attaching clip for attaching an attached object to be disposed on the face member; wherein the attaching clip is attached to pinch the joint cover member from an outer side thereof.

Preferably, the waterproof structure includes: a cover member having a plate portion and a fitting portion integrated to a lower face of the plate portion; wherein the fitting portion is attached to the constrained portions.

Preferably, at least a part of the constrained portions are disposed at an eave side of the building; and the cover member covers an eave of the building.

Preferably, at least a part of the constrained portions are disposed on a water upstream side of the building; and the cover member covers the water upstream side of the building.

Preferably, the waterproof structure includes: an adhesive material attached on the sealing member, for adhering to the end edge portions.

Preferably, the fitting portion includes a cross section having a substantially U-like shape with a narrowed opening.

The invention may provide a building, including: a roof; a supporting member that supports the roof; at least two face members each having an end edge portion, the at least two face members disposed on an exterior of the building so that the end edge portions are opposed to each other; a sealing member disposed between the end edge portions; and a joint covering member that is elastically deformable and disposed between the end edge portions; wherein the end edge portions are folded to protrude exteriorly and have constrained portions for narrowing a gap therebetween; the sealing member is disposed between the end edge portions to close the gap between the end edge portions; the joint covering member covers and presses the sealing member from an exterior side; and the joint covering member is attached to the constrained portions acting elastic force between the constrained portions.

According to one aspect of the invention, the sealing member is attached to close the gap between the end edge portions of the face members, and the joint cover member is formed by the elastic deformable member to press the sealing member to cover from the outer side and fit to attach to between the constrained portions by operating the elastic force. As a result, the sealing member is brought into close contact with the end edge portions of the press members and therefore, there is constituted a highly reliable waterproof structure which is difficult to leak water. Further, waterproof construction operation is facilitated.

At this occasion, there is not opening or the like of a fin-like sealing member by an ageing deterioration, which is excellent in durability.

According to another aspect of the invention, further, the anchor clip is inserted to between the end edge portions of the face members along the longitudinal direction of the end edge portion, the anchor clip is made to be able to be pressed to attach to the backing member at the back face of the face member by being locked by the two end edge portions of the face members and therefore, when the anchor clip is fixedly attached to the backing member by using the screw or the like after tackedly laying the face members. the face members can actually be fixed to the backing member.

At this occasion, the screw for fixedly attaching the anchor clip is covered by the joint cover and the sealing member and therefore, water is not leaked from the screw hole.

According to another aspect of the invention, further, the attaching clip is attached to pinch the joint cover member from an outer side, the attached object provided above the face member is attached by the attaching metal piece and therefore, the attached object can easily be attached while ensuring the waterproof structure.

According to another aspect of the invention, the cover member includes the plate portion and the fitting portion integrated to the low face, having the section substantially in the inverse U-like shape and having the shape narrowing the opening side, and the fitting portion is made to be fit to attach to the constrained portion. As a result, the cover member is fit to attach to the constrained portion and therefore, there is constituted a highly reliable waterproof structure which is difficult to leak water. Further, waterproof construction operation is facilitated.

At this occasion, there is not an opening or the like brought about in the fin-like sealing member by an ageing deterioration as in the prior art, which is excellent in durability.

According to another aspect of the invention, further, the cover member is the eaves side cover member and therefore, the cover member may only be fit to attach to between the member on the eaves side and the member including the projected portion having the constrained portion provided at the joint portion of the face members and waterproof construction operation is facilitated. Further, a nail head is not exposed, which is excellent in design performance.

According to another aspect of the invention, the cover member is on the water upstream side and therefore, the cover member may only be fit to attach to between the member on the water upstream side and the member including the projected portion having the constrained portion provided at the joint portion of the face members and waterproof construction operation is facilitated.

BRIEF DESCRIPTION OF THE DRAWINGS

The present invention may be more readily described with reference to the accompanying drawings:

FIGS. 1A and 1B show Embodiment 1 of the invention, in which FIG. 1A is a perspective view showing a waterproof structure of a roof and FIG. 1B is a sectional view taken along a line Ib-Ib of FIG. 1A.

FIGS. 10A and 10B show Embodiment 2 of the invention, in which FIG. 10A is a sectional view of a roof before attaching a sealing member and FIG. 10B is a sectional view showing a waterproof structure of the roof.

DETAILED DESCRIPTION OF THE PREFERRED EMBODIMENTS

A detailed explanation will be given of embodiments of the invention in reference to the drawings as follows.

Embodiment 1

Figure 1A:
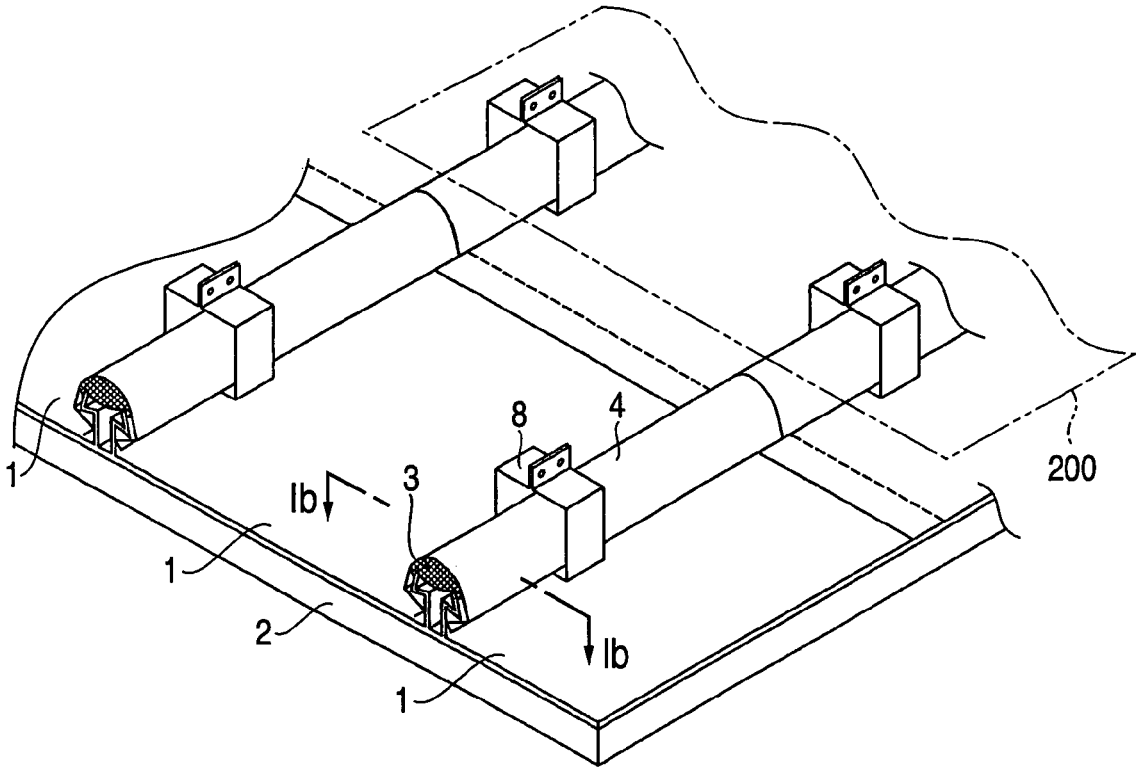
Figure 1B:
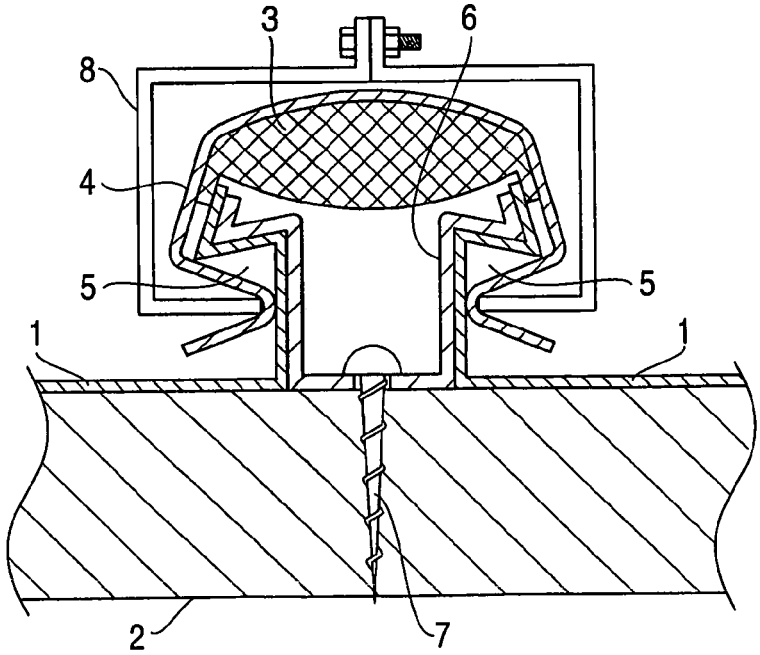
Figure 2A:
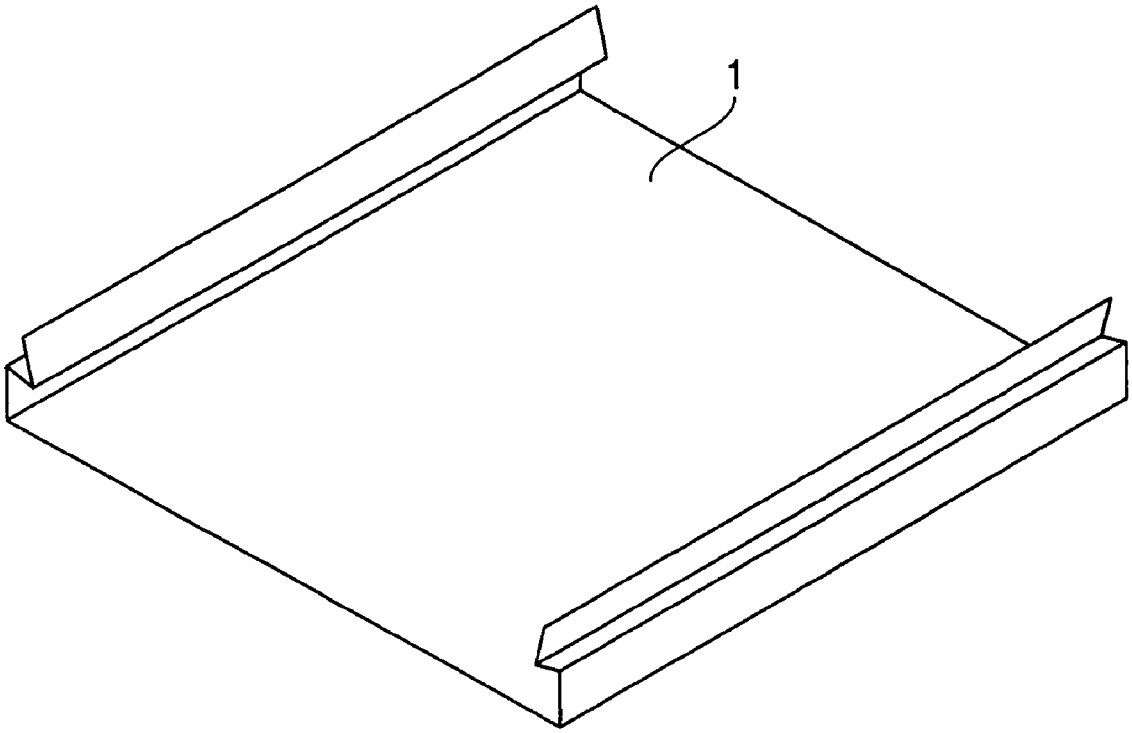
FIG. 2A is a perspective view of a roof face member and FIG. 2B is a sectional view thereof.
Figure 2B:
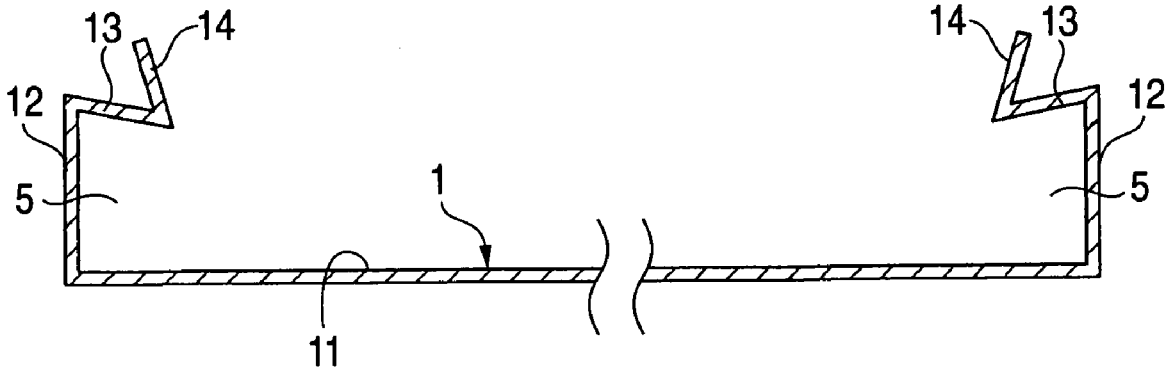
Figure 3:
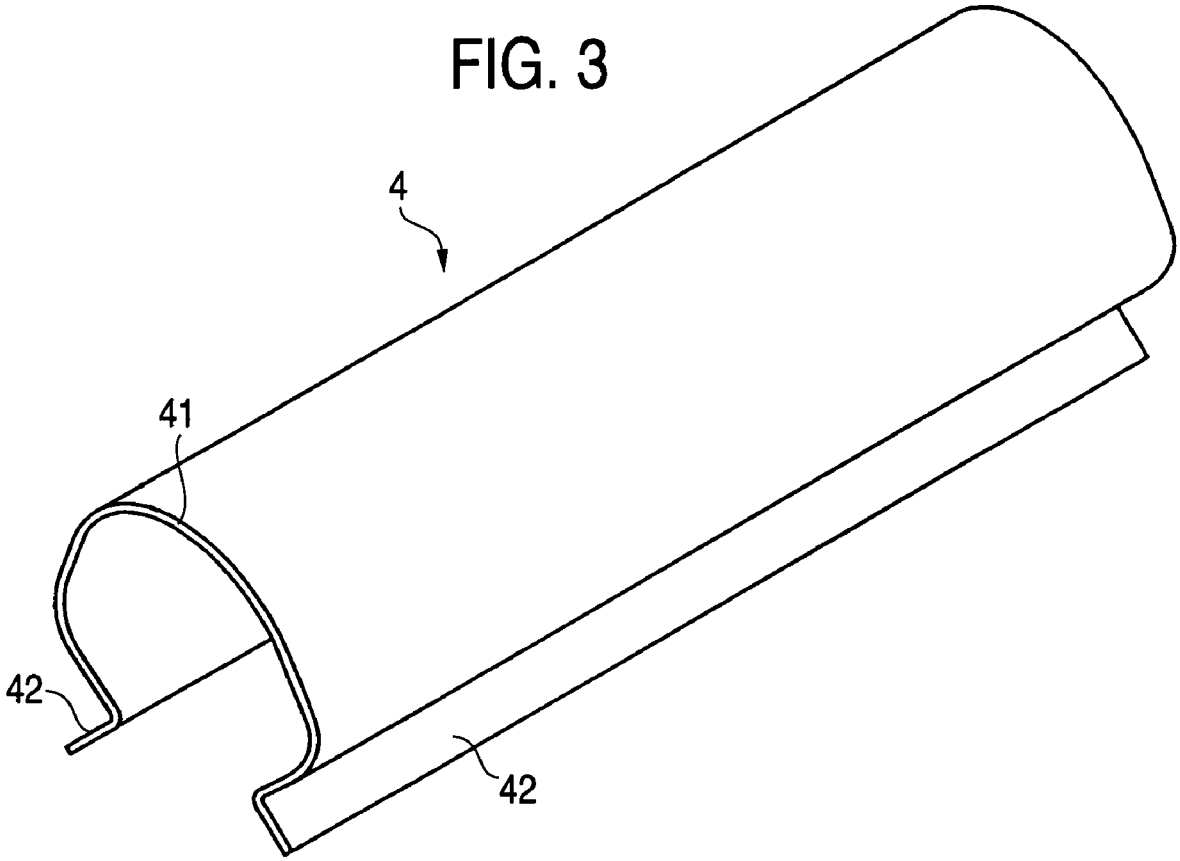
FIG. 3 is a perspective view of a joint cover member.
Figure 4:
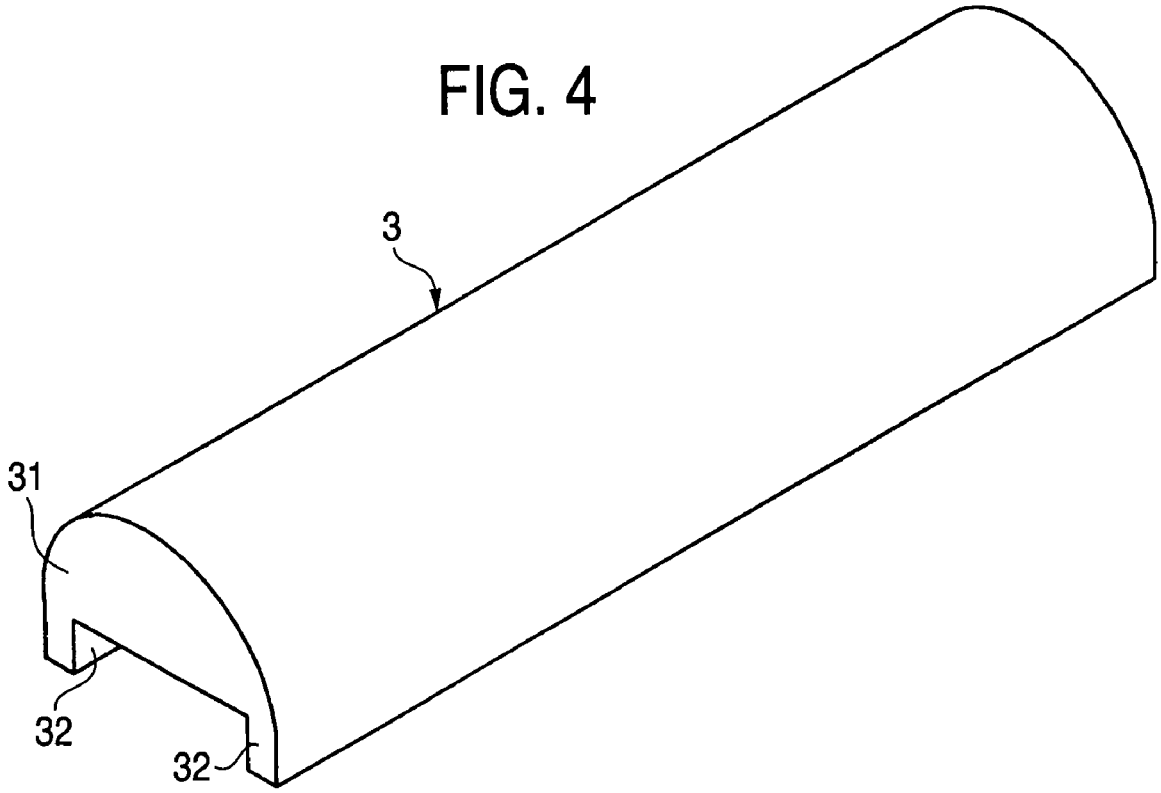
FIG. 4 is a perspective view of a sealing member.
Figure 5:
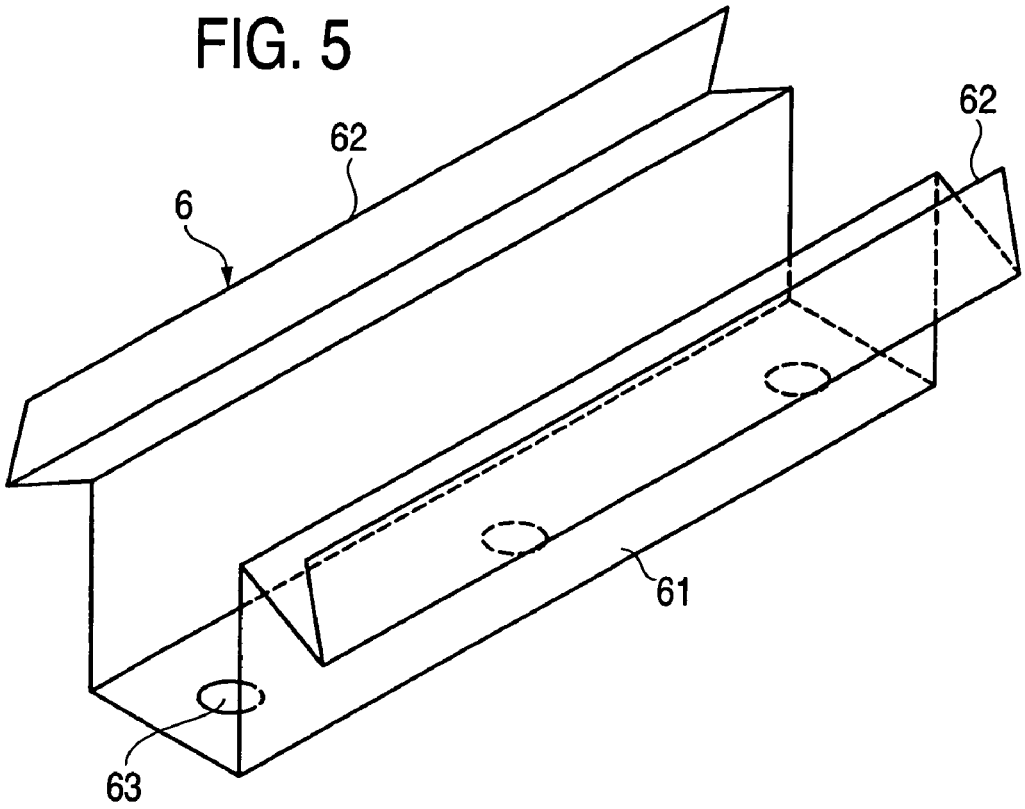
FIG. 5 is a perspective view of an anchor clip.
Figure 6:
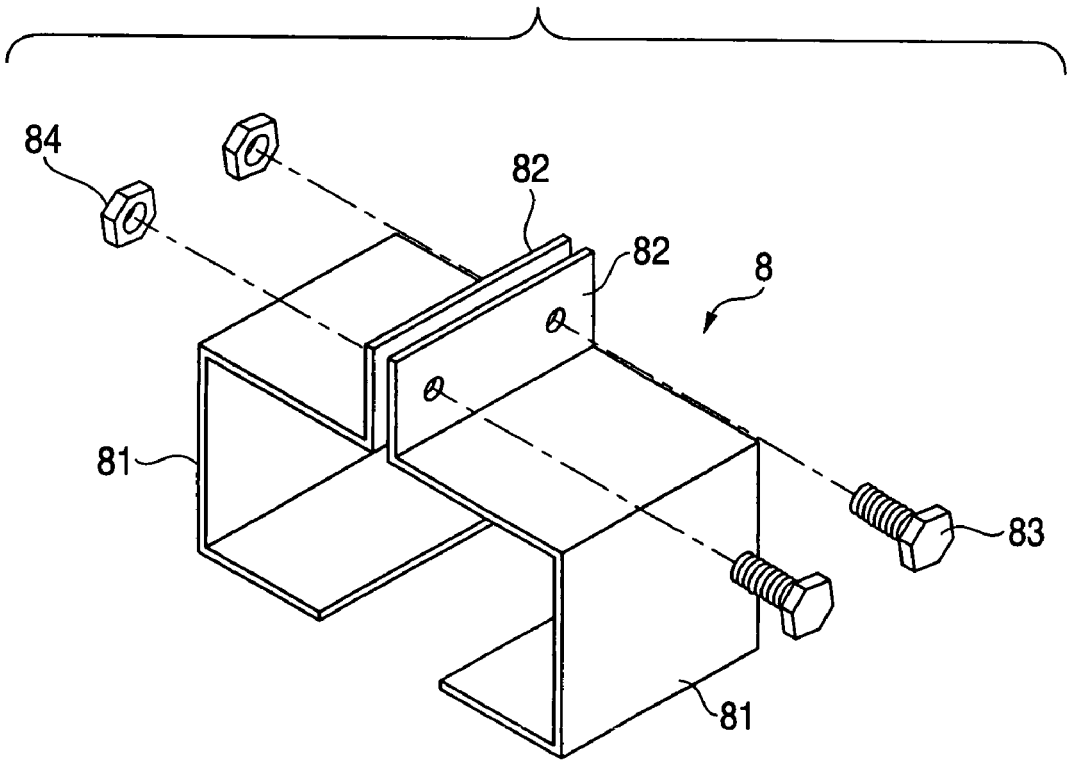
FIG. 6 is a disassembled perspective view of an attaching metal piece.

FIG. 1 through FIG. 6 show Embodiment 1 of the invention, FIG. 1A is a perspective view showing a waterproof structure of a roof, FIG. 1B is a sectional view taken along a line Ib-Ib of FIG. 1A. FIG. 2A is a perspective view of a roof face member and FIG. 2A is a sectional view thereof. FIG. 3 is a perspective view of a joint cover member. FIG. 4 is a perspective view of a sealing member. FIG. 5 is a perspective view of an anchor clip. FIG. 6 is a disassembled perspective view of an attaching metal piece.

Embodiment 1 is a waterproof structure of a building constituted by contiguously attaching roof face members 1, 1, 1, . . . on an exterior side of an upper face of the building and providing a sealing member 3 and a joint cover member 4 between end edge members of the roof face members 1 opposed to each other.

As shown by FIG. 1B, both of the end edge members of the roof face members 1, 1 contiguous to each other are folded to bend to project to the exterior side, roots of the two projected end edge portions are bulged from front end sides thereof and the roots of the two end edge portions are formed with constricted portions 5 for narrowing an interval between the end edge portions.

Explaining in further details in reference to FIG. 2, the roof face member 1 is formed by a metal sheet (sheet thickness: 0.3 through 0.6 mm) of a stainless steel sheet or a vinyl chloride resin coated steel sheet or the like and is formed by a flat roof main body 11, folded to bend portions 12 constituted by folding to bend both side end edge portions of the roof main body 11 in right angle, fold to bend portions 13 constituted by folding to bend front ends of the folded to bend portions 12, and fold to bend portions 14 constituted by further folding to bend front ends of the fold to bend portions 13 substantially upwardly.

According to the above-described roof face member 1, a width between the end edge portions is made to be 300 through 450 mm and a height dimension from the fold to bend portion 12 to an upper end of the fold to bend portion 14 is made to be 20 through 30 mm.

As shown by FIG. 1B, the sealing member 3 is attached to close an interval between the end edge portions of the roof face members 1, 1.

The sealing member 3 is formed by EPDM (ethylene-propylene terpolymer) foamed material, butyl species rubber, denatured silicone or the like.

As shown by FIG. 4, the sealing member 3 comprises a main body 31 having a long D-like shape, and a pair of leg portions 32, 32 hung from both sides of a bottom portion of the main body 31 and the leg portions 32, 32 are fit to attach to outer sides. of the fold to bend portions 14 of the roof face member 1.

The joint cover member 4 is formed by a metal sheet (sheet thickness: 0.3 through 0.6 mm) of a stainless steel sheet, vinyl chloride resin coated steel sheet or the like which is an elastic member and comprises a main body 41 having a long substantially cylindrical shape a lower side of which is opened and fold to bend portions 42 constituted by folding to bend lower end portions of the main body 41 to outer sides as shown by FIG. 3.

As shown by FIG. 1B, the joint cover member 4 presses the sealing member 3 to cover from an outer side and the above-described fold to bend portions 42, 42 are fit to attach to between the above-described constricted portions 5, 5 by operating an elastic force.

According to the waterproof structure of a building of Embodiment 1, a through anchor clip 6 is inserted into between the end edge portions of the roof face members 1, 1 along a longitudinal direction of the end edge portion (refer to FIG. 1).

The through anchor clip 6 is formed by a metal sheet of a stainless steel sheet, a vinyl chloride resin coated steel sheet or the like similar to the joint cover member 4 and comprises a main body 61 having a section substantially in a channel-like shape an upper side of which is opened and fold to bend portions 62, 62 constituted by folding to bend front ends of both sides of the main body 61 substantially in an angle-like shape.

the through anchor clip 6 is locked by the fold to bend portions 13, 13 formed at the two end edge portions of the roof face members 1, 1, a screw 7 is inserted into a screw hole 63 of the main body 61 and the screw 7 is screwed to a backing member 2 provided at a back face of the roof member 1 to press to attach thereto.

Further, according to the waterproof structure of a building of Embodiment 1, an attaching metal piece 8 is attached to pinch the joint cover member 4 from outer sides. An attached object 200 provided above the roof face member 1 is attached by the attaching metal piece 8.

As an example of the attached object, a solar panel integrated with a solar cell module, a balcony rail, an exterior machine of an air conditioning apparatus, a hot water supply machine or the like can be pointed out.

As shown by FIG. 6, the attaching metal piece 8 comprises a pair of metal piece main bodies 81, 81 each having a section in a channel-like shape, two pieces of bolts 83 and two piece of nuts 84 attached to fold to bend pieces 82, 82 opposed to each other at an upper portion of the metal piece main body 81.

A number of pieces of the attaching metal pieces 8 necessary for attaching the attached object are attached. For example, in the case of a solar panel, four pieces of the attaching metal pieces 8 are attached per one sheet of the panel.

Operation of Embodiment 1

According to the waterproof structure of a building of Embodiment 1 constituted as described above, the sealing member 3 is attached to close the interval between the end edge portions of the roof base members 1, 1, and the joint cover member 4 is formed by an elastic material and presses the sealing member 3 to cover from the outer side to fit to attach to between the above-described constricted portions 5, 5 by operating an elastic force. As a result, the sealing member 3 is brought into close contact with the end edge portions of the roof face members 1, 1 and therefore, there is constituted a highly reliable waterproof structure which is difficult to leak water.

Further, the sealing member 3 is made to be watertight by only fitting the joint cover member 4 to the constrained portions 5, 5 and therefore, waterproof construction operation is facilitated and high construction reliability is achieved without special technique.

At this occasion, there is not an opening or the like of a fin-like sealing member by an ageing deterioration as in the prior art, which is excellent in durability.

Further, the through anchor clip 6 is inserted into between the end edge portions of the roof face members 1, 1 along the longitudinal direction of the end edge portion and the through anchor clip 6 is locked by the two end edge portions of the roof members 1, 1 and is pressed to attach to the backing member 2 by the screw 7.

Therefore, when the roof face members 1, 1 are tackedly laid to adjust positions thereof and thereafter, the through anchor clip 6 is fixedly attached, the roof face member 1 can actually be fixed to the backing member 2 and a number of construction steps can be reduced.

At this occasion, the screw 7 for fixedly attaching the through anchor clip 6 is covered by the joint cover member 4 and the sealing member 3 and therefore, water is not leaked from the screw hole 63.

Furthermore, the attaching metal piece 8 is attached thereto to pinch the joint cover member 4 from the outer side, the attached object provided above the roof face member 1 is attached by the attaching metal piece 8 and therefore, the attached member can easily be attached while ensuring the waterproof structure. Further, the attached object can easily be attached after construction.

Modified Examples of Embodiment 1

Figure 7:
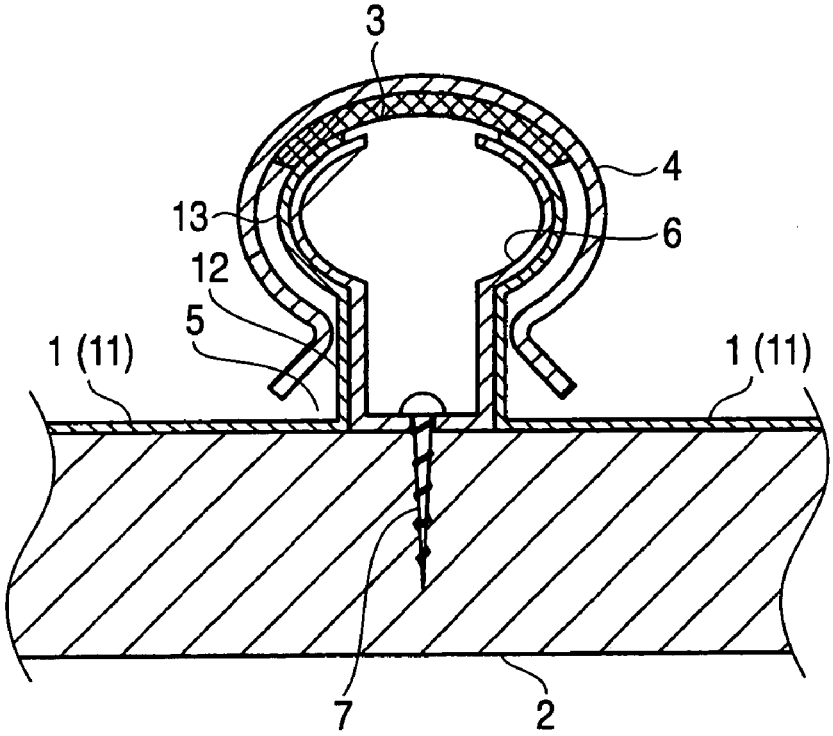
FIG. 7 is a sectional view of a waterproof structure of a roof according to Modified Example 1 of Embodiment 1.
Figure 8:
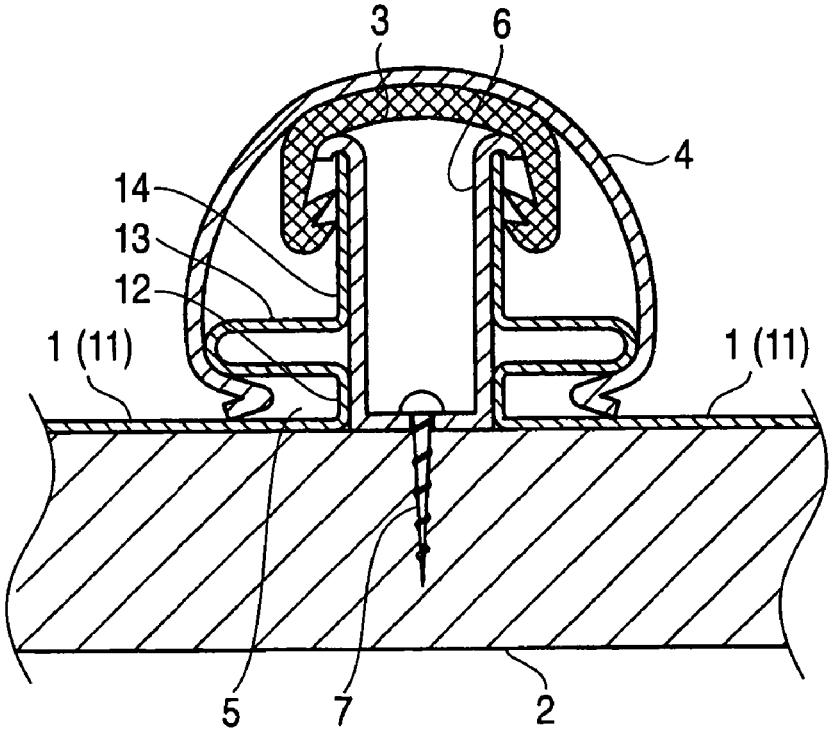
FIG. 8 is a sectional view of a waterproof structure of a roof according to Modified Example 2 of Embodiment 1.
Figure 9:
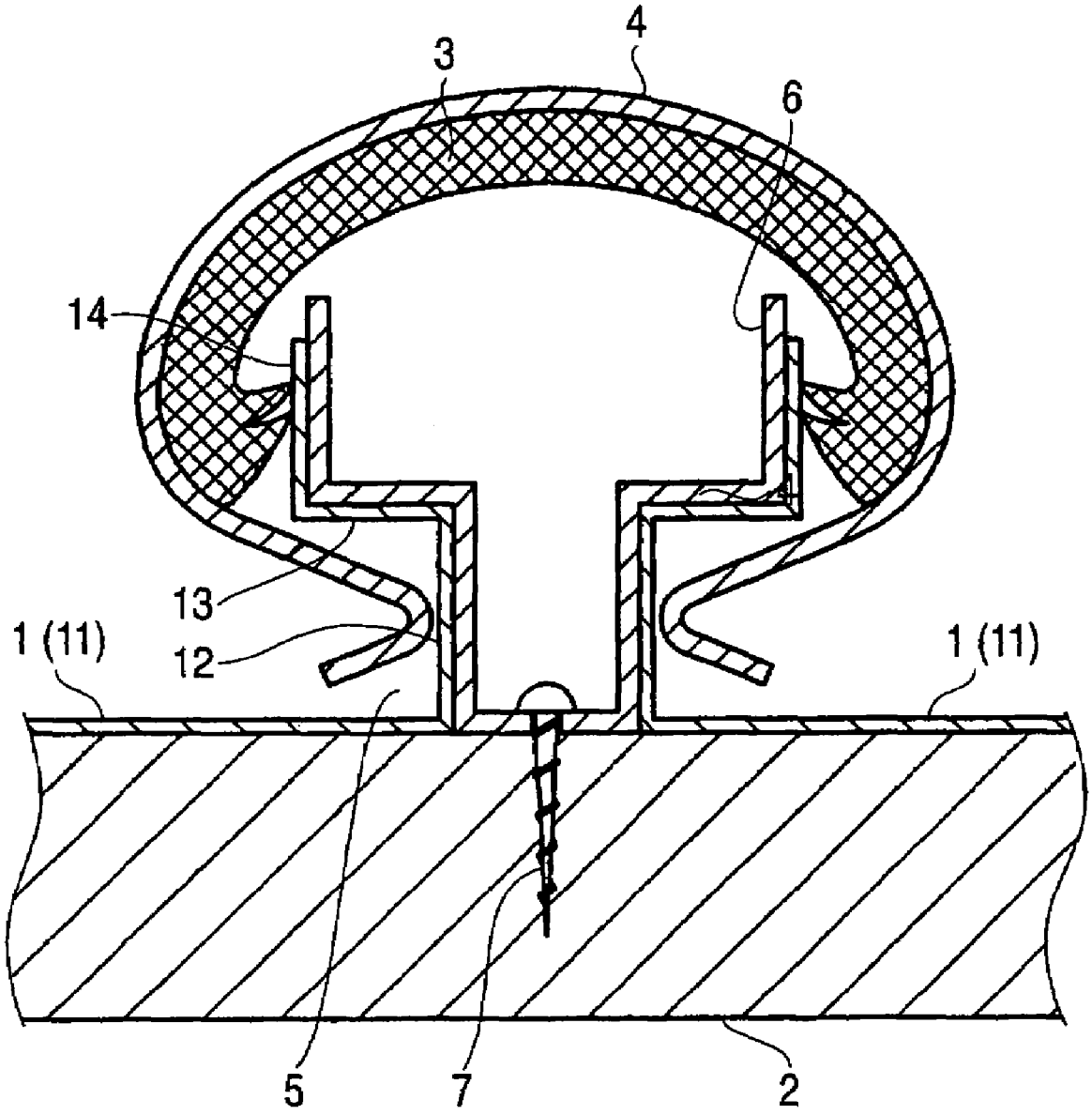
FIG. 9 is a sectional view of a waterproof structure of a roof according to Modified Example 3 of Embodiment 1.

FIG. 7 through FIG. 9 are sectional views of waterproof structures of a roof according to modified examples of Embodiment 1.

Modified Example 1

According to Modified Example 1 shown in FIG. 7, although the shape of the constrained portion 5 of the roof face member 1, the shape of the sealing member 3, the shape of the joint cover member 4, the shape of the anchor clip 6 and the like more or less differ from those of FIG. 1, the shapes are essentially similar thereto.

The roof member 1 shown in FIG. 7 is formed by a flat roof main body 11, fold to bend portions 12 constituted by folding to bend both side end edge portions of the roof main body 11 in right angle and fold to bend portion 13 having a semicircular arc shape constituted by being folded to bend to bulge to inner sides at front ends of the fold to bend portions 12.

The sealing member is formed in a shape of a thick-walled sheet and disposed a back face of the joint cover member 4 and may integrally formed with the joint cover member 4 or separately therefrom.

Although the shape of the joint cover member 4 and the shape of the anchor clip 6 are formed to fix to the shape of the fold to bend portion 13 in the semicircular arc shape of the face member 1, the shapes remain unchanged essentially from the shapes of FIG. 1.

Modified Example 2

According to Modified Example 2 shown in FIG. 8, the roof face member 1 is formed by the flat roof main body 11, the fold to bend portion 12 constituted by folding to bend the both side end edge portions of the roof main body 1 in right angle, the fold to bend portion 13 folded to bend to bulge substantially in a U-like shape to an inner side at the front end of the fold to bend portion 12 and a fold to bend portion 14 folded to bend from the fold to bend portion 13 in the U-like shape in right angle to direct to the upper side.

The sealing member 3 is constituted by a thick-walled section substantially in C-like shape a lower side of which is opened, inner sides of front ends of both sides thereof are constituted by a fin-like shape to be brought into contact with the inner side of the fold to bend portion 14 of the roof face member 1.

The joint cover member 4 is constituted by a section substantially in a C-like shape a lower side of which is opened and an opening end portion thereof is locked by the fold to bend portion 13 in the U-like shape of the roof face member.

The anchor clip 6 is constituted by a section substantially in a channel-like shape an upper side of which is opened, front end portions on both sides thereof are folded to bend to outer sides in a hook-like shape and the anchor clip 6 is locked by catching front end portions thereof in the hook-like shape by front ends of the fold to bend portions 14 of the roof face member 1 different from those of Embodiment 1 and Modified Example 1 thereof, mentioned above.

Modified Example 3

According to Modified Example 3 shown in FIG. 9, other than the sealing member 3 is constituted by shapes substantially the same as those of Embodiment 1 shown in FIG. 1.

The sealing member 3 of FIG. 9 is constituted by a thick-wall section substantially in a C-like shape inner sides of front ends of both sides of which-are constituted by a fin-like shape and is brought into contact with inner sides of the fold to bend portions 14 of the roof face member 1.

Further, Modified Examples 1 through 3 shown in FIG. 7 through FIG. 9 are constructed by constitutions essentially similar to that of Embodiment 1 and achieve operation the same as that of Embodiment 1 and therefore, an explanation thereof will be omitted.

Embodiment 2

Figure 10A:
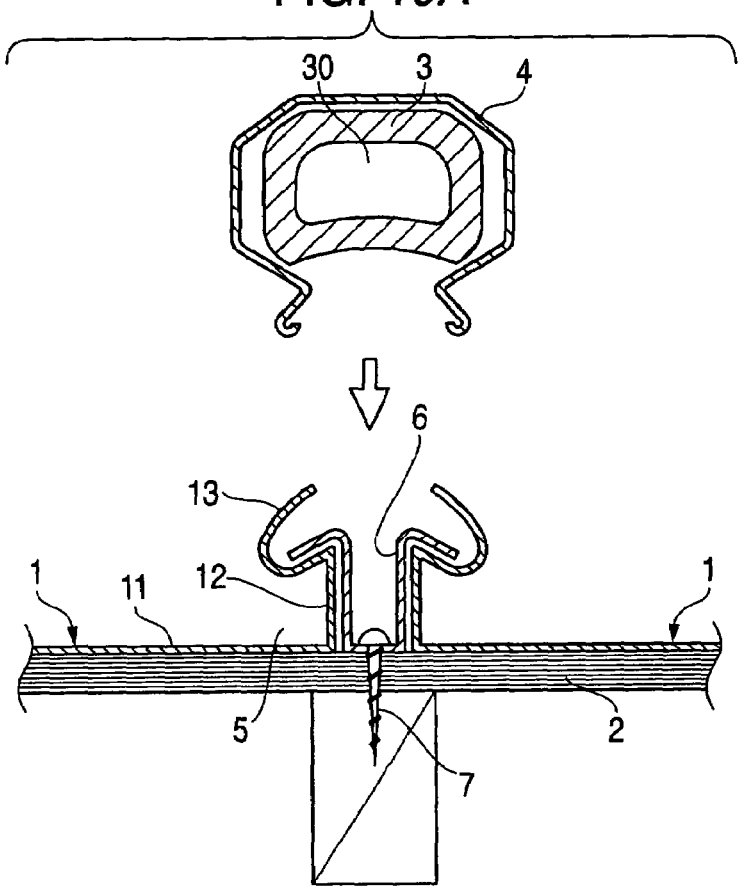
Figure 10B:
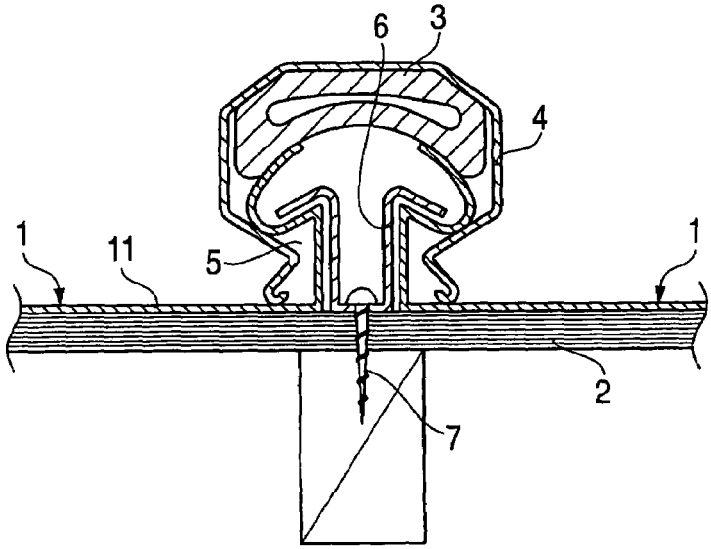

FIG. 10 shows Embodiment 2 of the invention, FIG. 10A is a sectional view of a roof for attaching a sealing member and FIG. 10B is a sectional view showing a waterproof structure of a roof.

Embodiment 2 is a waterproof structure of a building provided with the sealing member 3 between the contiguous roof face members 1, 1 of the building.

As shown by FIG. 10A, the sealing member 3 is constituted by a section substantially in a shape of a square cylinder and includes a hollow portion 30 and is attached to between the end edge portions of the roof face members 1, 1 by being deformed to press to crush the hollow portion 30 to make the interval between the end edge portions of the roof face members 1, 1 watertight.

According to the waterproof structure of the building, the roof face member 1 is constituted by a shape similar to that of Embodiment 1 and is formed by the flat roof main body 11, the fold to bend portions 12 constituted by folding to bend the both side end edge portions of the roof main body 11 in right angle and the fold to bend portions 13 constituted by folding to bend front ends of the fold to bend portions 12 substantially in a U-like shape.

The end edge portion (joint portion) between the roof face members 1, 1 is provided with the sealing member 3 and the joint cover member 4, the joint cover member 4 covers the sealing member 3 from the outer side to press to crush the hollow portion 30 and is fixed to the constrained portions 5 between the end edge portions of the contiguous roof face members 1, 1.

Further, the through anchor clip 6 is inserted to between the end edge portions of the roof face members 1, 1 along the longitudinal direction of the end edge portion similar to Embodiment 1 (refer to FIG. 10).

The through anchor clip 6 is constituted by a section substantially in a channel-like shape the upper side of which is opened, front ends of both sides thereof are folded to bend substantially in an angle-like shape and locked by the fold to bend portions 13, 13 in the U-like shape formed at the both end edge portions of the roof face members 1, 1 and the anchor clip 6 is screwed to press to attach to the backing member 2 provided at the back face of the face member 1 by using the screw 7.

Operation of Embodiment 2

According to the waterproof structure of the building of Embodiment 2 constituted in this way, the sealing member 3 includes the hollow portion 30 and is attached to between the roof face members 1, 1 by being deformed to press to crush the follow portion 30 to make the interval between the roof face members 1, 1 watertight and therefore, there is constructed a highly reliable waterproof structure which is difficult to leak water.

Even in an arrangement having a stepped difference between the roof face members 1, 1, the sealing member 3 can deal therewith by the same member, further, even when a stepped difference is produced between the roof face members 1, 1 by construction error or the like, the stepped difference can be absorbed thereby.

Further, the sealing member 3 and the joint cover member 4 are provided at the end edge portions between the roof face members 1, 1, the joint cover member 4 covers the sealing member 3 from the outer side and is fit to between the end edge portions of the contiguous roof face members 1, 1 and therefore, the sealing member 3 is not exposed directly to outer air. Therefore, a deterioration by the sealing member 3 by direct sunlight or the like is prevented and durability thereof is improved.

Embodiment 3

Figure 11:
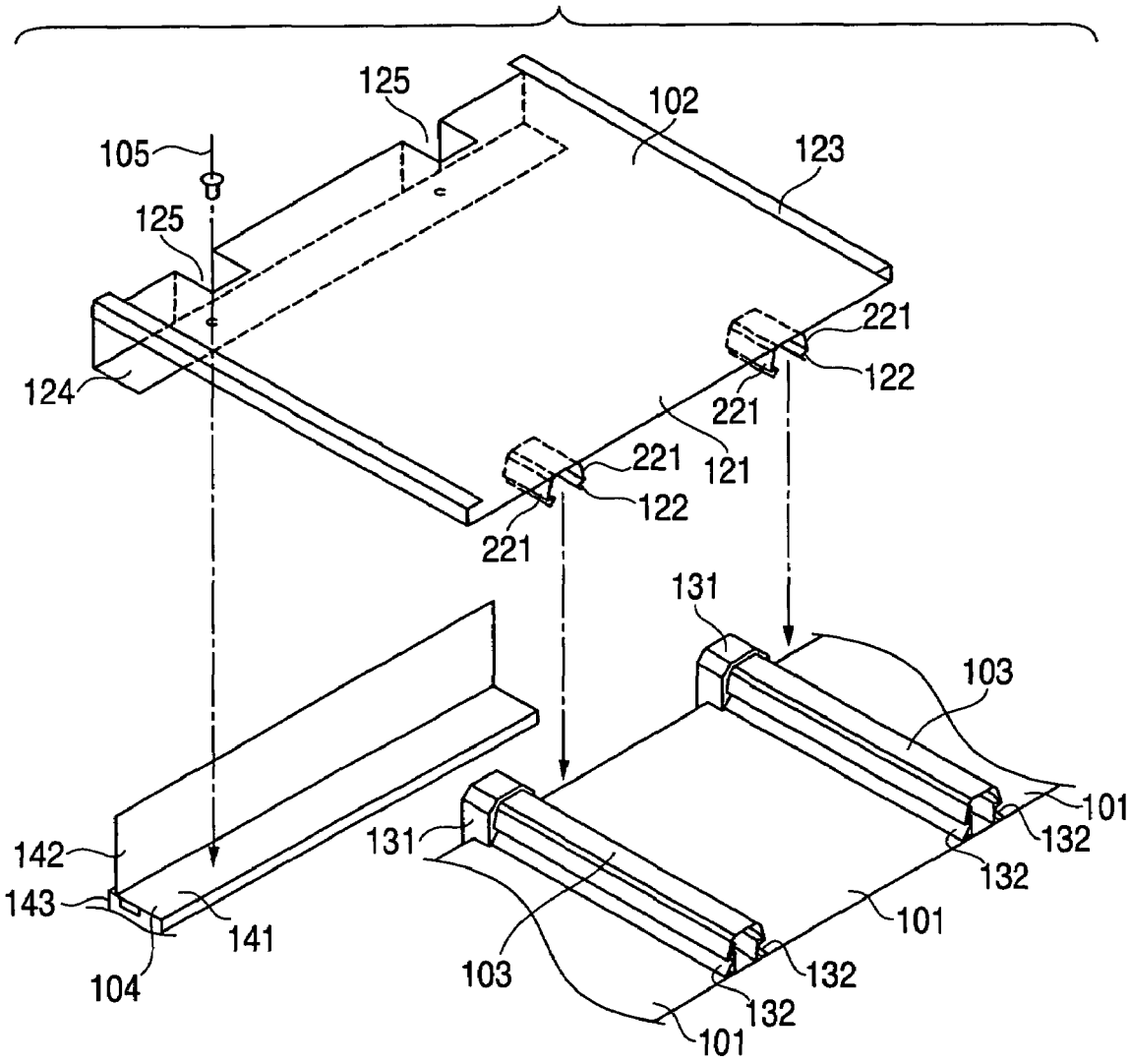
FIG. 11 is an explanatory view of attaching an eaves side cover provided between a roof and a cover above a gutter.
Figures 12A, 12B, 12C, 12D:
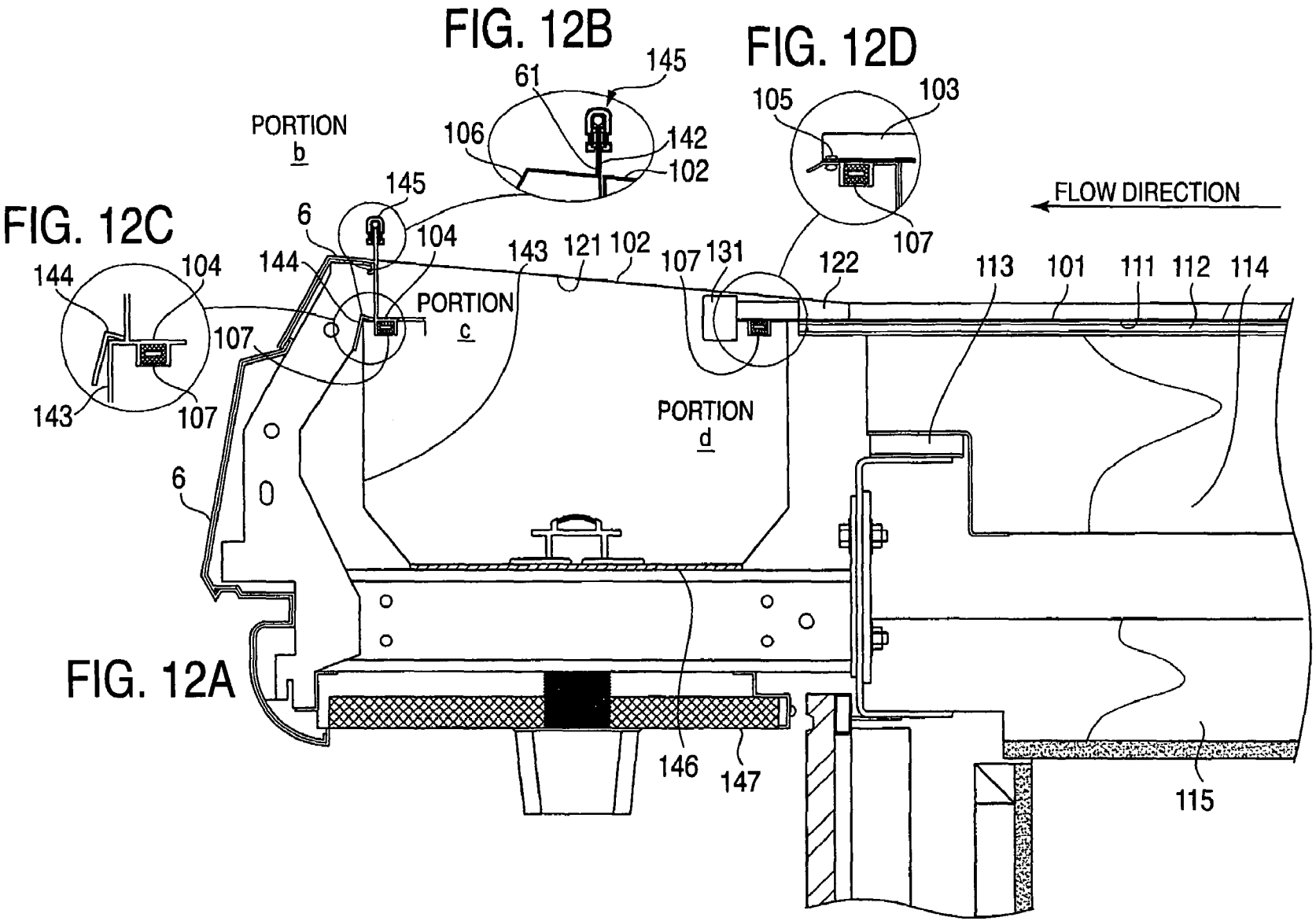
FIG. 12A is a sectional view of an eaves side of a roof.
FIG. 12B is a sectional view enlarging a portion b.
FIG. 12C is a sectional view enlarging a portion c.
FIG. 12D is a sectional view enlarging a portion d.

FIG. 11 and FIGS. 12A-D show Embodiment 3 of the invention, FIG. 11 is an explanatory view of attaching an eaves side cover provided between a roof and a cover above a gutter, FIG. 12A is a sectional view of an eaves of the roof, FIG. 12B is a sectional view enlarging a portion b, FIG. 12C is a sectional view enlarging a portion c and FIG. 12D is a sectional view enlarging a portion d.

According to Embodiment 3, roof face members 101, 101, 101 . . . are contiguously attached to an exterior side of an upper face of a building and a joint cover member 103 is provided between end edge portions of the roof face member 101 opposed to each other. A cover member of the invention is an eaves side cover member 102, the eaves side cover member 102 includes a flat plate portion 121 and fitting portions 122, 122 integrated to a lower face of one end side thereof, having a section substantially in an inverse U-like shape and having a shape of narrowing an opening side thereof, and opposed sides of the fitting portions 122, 122 are provided with a jointing portion 124 folded to bend downwardly in a channel-like shape, and notches 125, 125 in a channel-like shape as a space for jointing with a cover 104 above a gutter by using a rivet 105. Further, end portions of the eaves side cover member 2 orthogonal to the fitting portions 122, 122 and the jointing portion 124 and the like include raised portions 123, 123 in a channel-like shape.

Explaining further in details in reference to FIG. 11, FIGS. 12A-D, the jointing portion 124 of the eaves side cover member 102 is positioned between a flat plate portion 141 and a raised portion 142 of the cover 104 above a gutter, and the fitting portions 122, 122 integrated to the lower face of the eaves side cover member 102, having the section substantially in the inverse U-like shape and narrowing the opening side are fit to constrained portions 132, 132 of the joint cover members 103 of the roof face members 101.

The roof face member 101 and the joint cover member 103 are formed by metal sheets (sheet thickness: 0.1 through 0.6 mm) of stainless steel sheets, vinyl chloride resin coated steel sheets or the like. Similarly, also the eaves side cover member 2 and the fitting portions 122, 122 integrated to the lower face, having the section substantially in the inverse U-like shape and narrowing the opening side are formed by metal sheets (sheet thickness: 0.3 through 0.6 mm) of stainless steel sheets, vinyl chloride resin coated steel sheet or the like which are elastic members, and as shown by FIG. 11, and as shown by FIG. 11, fold to bend portions 221, 221 are fit to attach between the constrained portions 132, 132 of the joint cover members 3 by operating an elastic force.

FIGS. 12A-D are sectional views showing an eaves side on a downstream side of water as shown by an arrow mark of a flow direction in the drawing, the roof face member 101 is formed by the above-described steel sheet above a backing member 112 comprising a roof board having a plate thickness of 12 mm and a waterproof layer 111 of asphalt roofing and is supported by a ceiling joist 115 and a rafter 114.

A gutter 143 is attached to a side of the end edge portion (downstream side of water on the left side of the drawing) of the roof face member 101 and a parapet 106 which is an eaves side decorative sheet is attached thereto. An eptsealer (sound absorbing material) 146 is laid at a lower portion of the gutter 143 and an eaves side panel 147 is attached further therebelow.

As shown by FIG. 12D, according to the eaves side cover 102 of the invention, on the side of the end edge portion of the roof face member 101, one end side of the gutter 143 is sealed by a butyl tape 107 to prevent water and fixed to the end edge portion of the roof face member 101 by the rivet 105. Further, the fitting portion 122 of the eaves side cover member 102 is fit to attach to the joint cover member 103 of an inner side (right side of FIG. 12) of an eaves side cap 131 from thereabove. Further, as shown by FIG. 12C, other end side on the exterior side of the gutter 143 is sealed to prevent water by the cover member 4 above the gutter, the jointing portion 124 on the exterior side of the eaves side cover member 102 and the butyl tape 107 and is fixed by the rivet 105. Further, as shown by FIG. 12B, the raised portion 142 of the cover member 104 above the gutter and an upper end portion 161 of the parapet 106 are sealed to prevent water by a trim 145 above the eaves.

According to the waterproof structure of a building of Embodiment 1 constituted in this way, the eaves side cover member 102 comprises the flat plate portion 121 and the fitting portions 122, 122 integrated to the lower face, having the section substantially in the inverse U-like shape and having the shape narrowing the opening side, and the fitting portions 122, 122 are fit to attach to the constrained portions 132, 132 of the joint cover members 103 provided between the end edge portions of the roof face members 101, 101, 101 . . . attached contiguously and opposed to each other and having projected portions having constrained portions. As a result, the eaves side cover member 102 is fitted to attach to the constrained portions of the joint cover member 103 provided at the joint portion of the roof face member 101 an therefore, there is constituted a highly reliable waterproof structure which is difficult to leak water. Further, waterproof construction operation is facilitated.

At this occasion, according to the eaves side cover member 102 of the invention, the fitting portion 122, 122 are constituted by metal elastic members and therefore, there is not an opening or the like which is brought about in the fin-like sealing member by an ageing deterioration as in the prior art, which is excellent in durability.

Further, although the eaves side cover member 102 and the cover member 104 are fixed by the rivet 105, a nail head thereof is not exposed, which is excellent in design performance and waterproof performance.

Figure 13A:
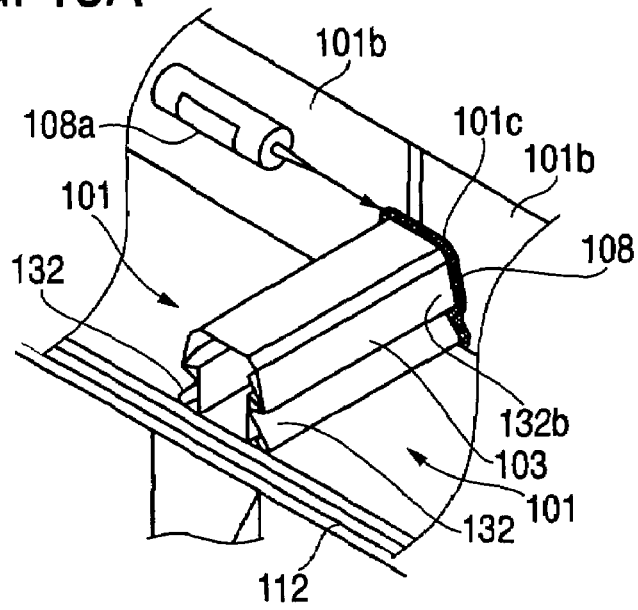
FIGS. 13A and 13B are explanatory views of attaching a cover on an up stream side of water provided between a proof portion on an upstream side of water and a joint cover.
Figure 13B:
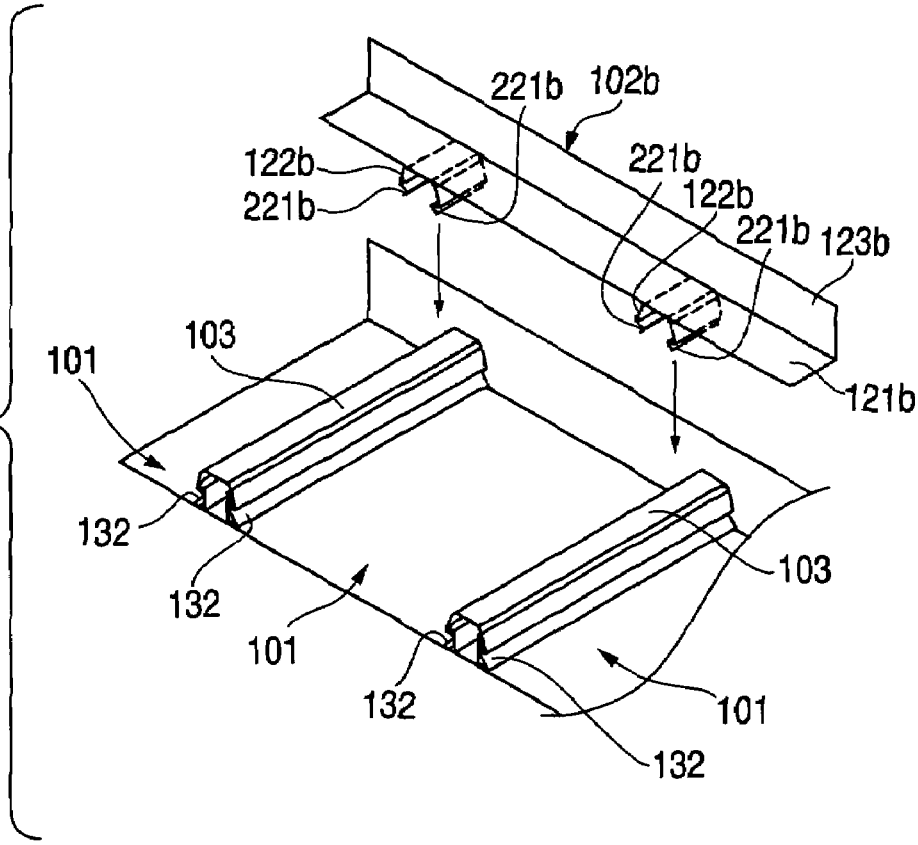
Figures 14A, 14B:
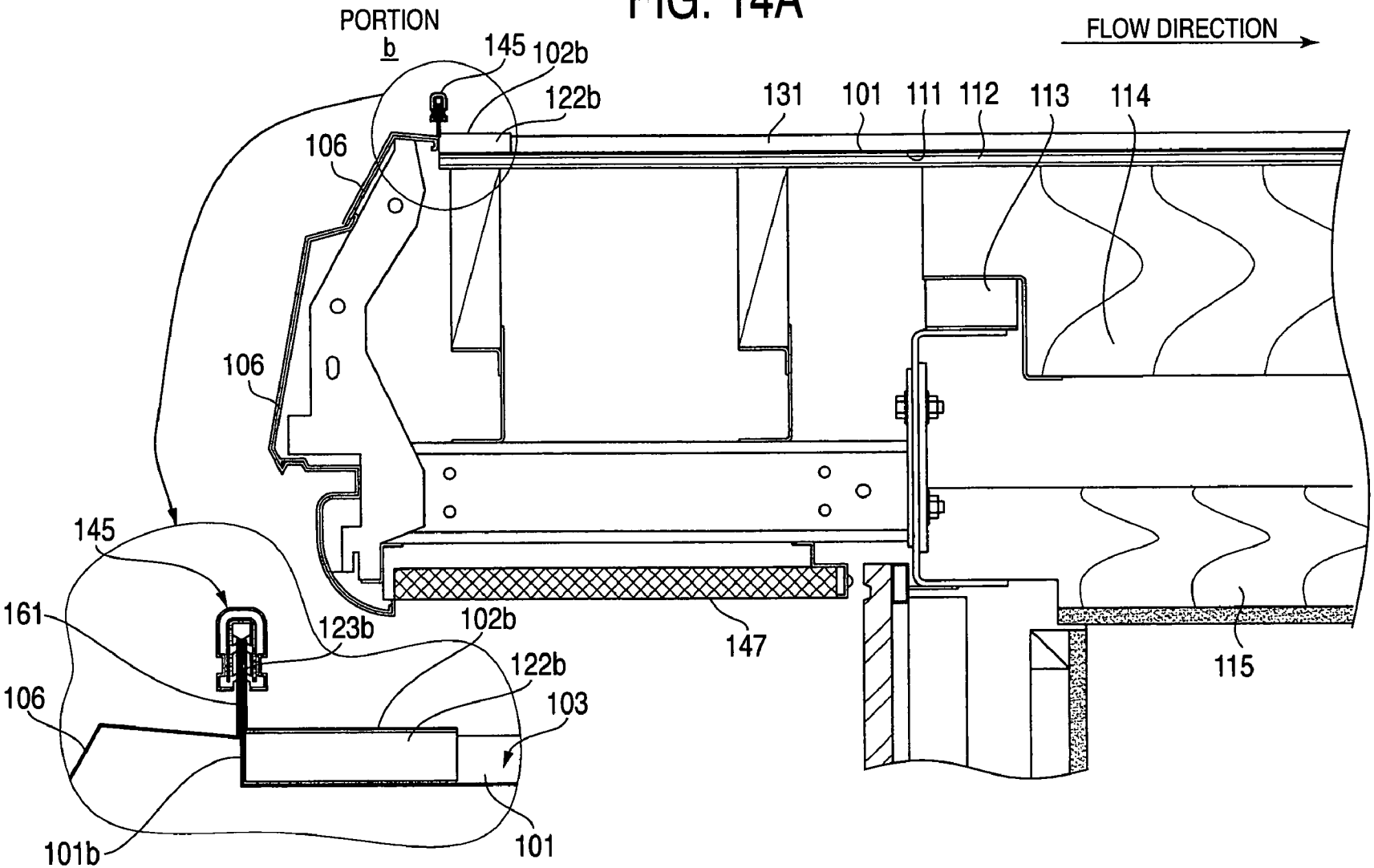
FIG. 14A is a sectional view of a roof on an upstream side of water.
FIG. 14B is a sectional view enlarging a portion b.

FIGS. 13A-B and FIGS. 14A-B show Embodiment 4 of the invention, FIG. 13A-B illustrate explanatory views of attaching a cover on an upstream side of water provided between a roof on an upstream side of water and a joint cover, FIG. 14A is a sectional view of the roof on the upstream side of water and FIG. 14B is a sectional view enlarging a portion b.

According to Embodiment 4 , the roof face members 101, 101, 101, . . . are contiguously attached to the exterior side of the upper face of a building and the joint cover member 103 is provided between the end edge portions of the roof face members 101, 101 opposed to each other. A cover member of the invention is a cover member 102*b* on an upstream side of water, and the cover member 102*b* on the upstream side of water is provided with a section in an L-like shape by a flat plate portion 121*b* and a raised portion 123*b* and includes fitting portions 122*b*, 122*b* integrated to the lower face thereof, having a section substantially in an inverse U-like shape and having a shape narrowing an opening side thereof.

Explaining further in details in reference to FIGS. 13A-B and FIG. 14A-B, a sealing member 108 of denatured silicone or the like is coked by a coking gun 108*a* at a butting portion 101*c* of butting raised portions 132*b* on the upstream side of water of the joint cover member 103 provided between the end edge portions of the roof face members 101, 101 opposed to each other and raised portions 101*b* of the roof face members 101. Fitting portions 122*b*, 122*b* of the cover members 102*b* on the upstream side of water are fit to the constrained portions 132, 132 of the joint cover members 103 thereabove.

The cover member 102*b* on the upstream side of water is formed by a metal sheet (sheet thickness: 0.3 through 0.6 mm) of a stainless steel sheet, a vinyl chloride resin coated steel sheet or the like similar to the roof face member 101. Similarly, also the fitting portions 122*b*, 122*b* integrated to the lower face of the cover 102 on the upstream side of water, having the section substantially in the inverse U-like shape and narrowing the opening side are formed by metal sheets (sheet thickness: 0.3 through 0.6 mm) of stainless steel sheets, vinyl chloride resin coated steel sheets or the like which are elastic members and as shown by FIG. 13, fold to bend portions 221*b*, 221*b* are fit to attach to the constrained portions 131, 131 of the joint cover member 3 by operating an elastic force.

FIGS. 14A-B are sectional views showing the eaves side on the upstream side of water as shown by an arrow mark of a flow direction of the drawing, the roof face member 1 is formed by the above-described steel sheet above the backing member 112 comprising the roof board having the plate thickness of 12 mm and the waterproof layer 111 of asphalt roofing and supported by the ceiling joist 115 and the rafter 114.

The side of the end edge portion (upstream side of water on the left side of the drawing) of the roof face member 101 is attached with the parapet 106 which is the eaves side decorative member. The eaves side panel 147 is attached therebelow.

According to the cover member 102 on the upstream side of water of the invention, on the side of the end edge portion of the roof face member 101, as shown by enlarging the portion a in FIG. 14B, the raised portion of the roof face member 101, the raised portion 123*b* of the cover member 102*b* on the upstream side of water, and the upper end portion 161 of the parapet 106 are pinched by the trim 145 above the eaves to seal to prevent water.

According to the waterproof structure of a building of Embodiment 4 constituted in this way, the cover member 102*b* on the upstream side of water comprises the flat plate portion 121*b* and the fitting portions 122*b*, 122*b* integrated to the lower face, having the section substantially in the inverse U-like shape and having the shape narrowing the opening side and the fitting portions 122*b*, 122*b* are fit to attach to the constrained portions 132, 132 of the joint cover members 3 provided between the end edge portions of the roof face members 101, 101, 101 . . . attached contiguously and including projected portions having constrained portions. As a result, the cover member 2*b* on the up stream side of water is fit to attach to the constrained portions 132, 132 of the joint cover member 103 provided at the jointing portion of the roof face member 101 and therefore, there is constituted a highly reliable waterproof structure which is difficult to leak water. Further, waterproof construction operation is facilitated.

At this occasion, according to the cover member 102*b* on the upstream side of water of the invention, the fitting portions 122*b*, 122*b* are constituted by metal elastic member sand therefore, there is not an opening or the like brought about at the fin-like sealing member by an ageing deterioration as in the prior art, which is excellent in durability.

Although an explanation has been given of embodiments of the invention in reference to drawings as described above, the invention is not limited to the embodiments but even when design thereof is changed within a range which does not change the gist of the invention, the change is included in the invention.

Figure 17:
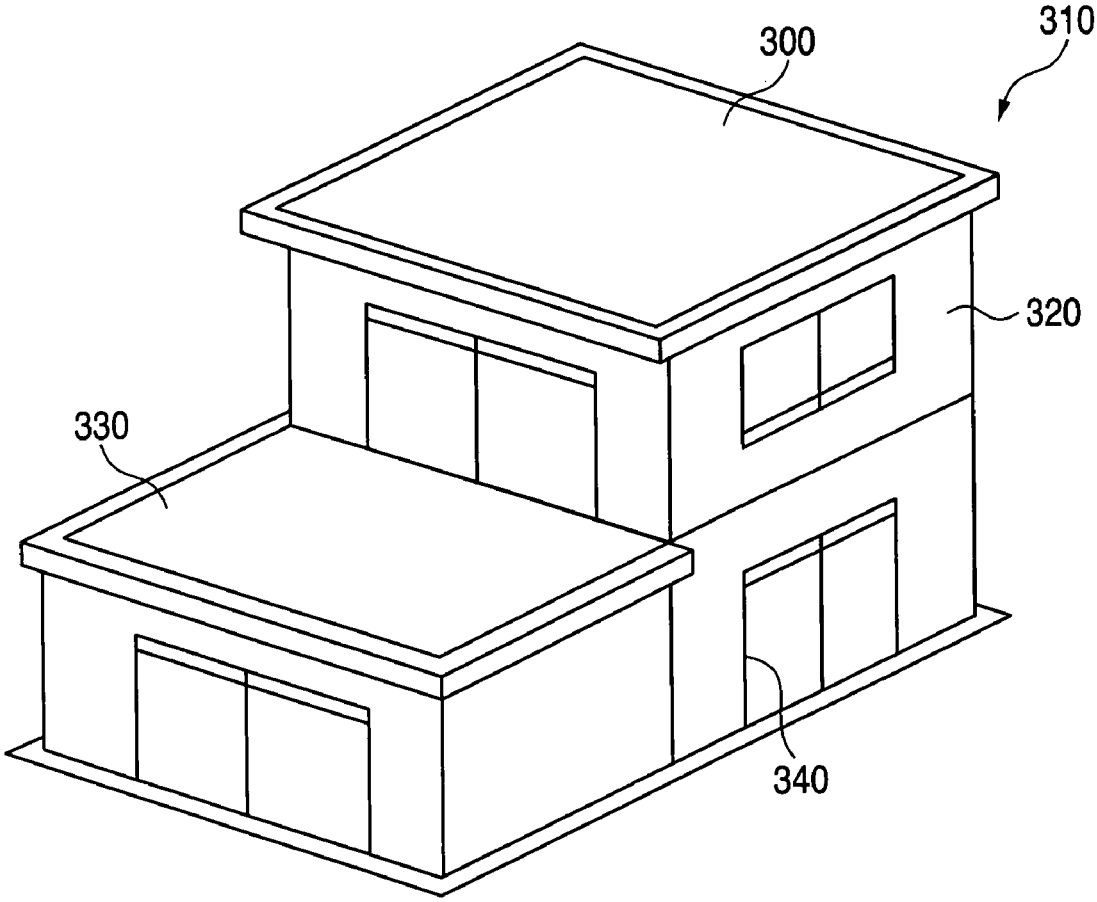
FIG. 17 is a perspective view of a building according to an embodiment of the invention.
Figure 18:
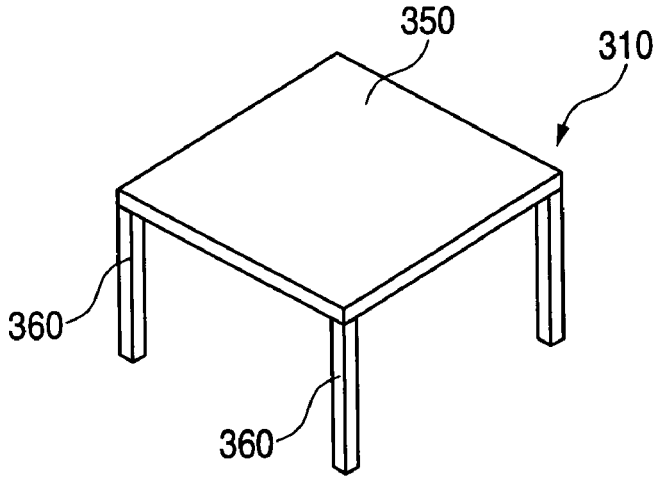
FIG. 18 is a perspective view of a building according to another embodiment of the invention.

For example, although according to the above embodiments, the contiguous face members are the roof face members 1, 1, that is arranged on a roof 300 of a building 310 as shown in FIG. 17, the face members may form joint portions outside of the building 310 of an outer wall 320, a balcony floor 330, a surrounding of an opening 340 and the like. In addition, as shown in FIG. 18, the building 310 may be a simple structure having a roof 350 and pillars 360 for supporting the roof 350, such as a barn or a depository.

Figure 15:
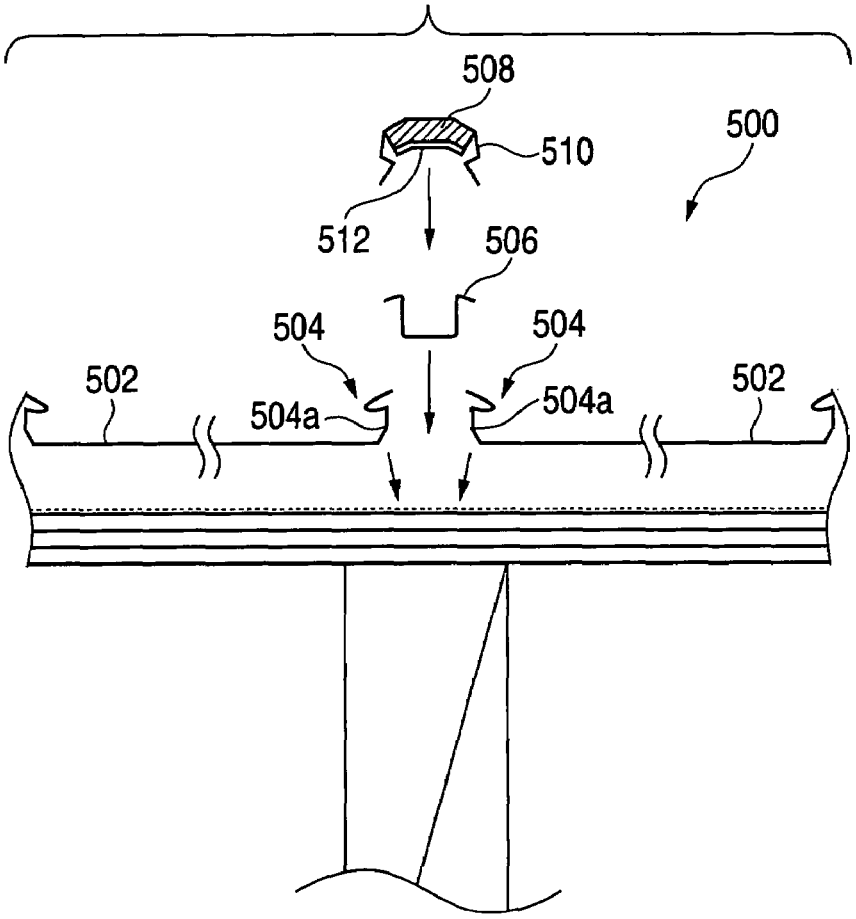
FIG. 15 is an elevational disassembled view showing a cross section of a waterproof structure according another embodiment.
Figure 16:
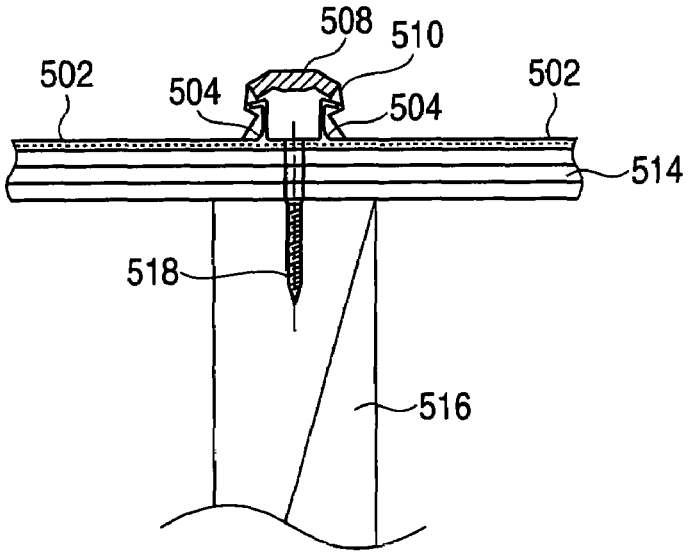
FIG. 16 is an elevational view showing a cross section the waterproof structure shown in FIG. 15 in a state that the structure is assembled.

The roof structure may be a structure as shown in FIGS. 15 and 16. The roof structure 500 shown in FIGS. 15 and 16 includes face members 502 having end edge portions 504, an anchor clip 506, a sealing member 508, and a joint covering member 510. The sealing member 508 is integrally attached on an inner surface of the joint covering member 510. The sealing member 508 is made of a mixture of an EPDM (ethylene-propylene terpolymer) foamed material and a butyl rubber. An adhesive material 512 made of a butyl rubber is attached on the lower side of the joint covering member 510.

The anchor clip 506 is inserted into a gap between the end edge portions 504 so as to fit with constrained portions 504*a* of the end edge portions 504.

FIG. 16 shows an assembled state of the roof structure 500. As shown in FIG. 16, the face members 502 are disposed onto the roof plate 514 together with the anchor clip 506. The face members 502 are arranged so that the joint portion therebetween extends along a beam member 516 for supporting the roof plate 514. The anchor clip 506 sandwiched between the end edge portions 504 is disposed along the beam member 516 and is fixed to the beam member 516 by using a bolt 518. The joint cover member 510 is disposed on the joint portion between the end edge portions 504 engaging with the constrained portions 504*a* from the exterior acting elastic force between the end edge portions 504. By this elastic force, the sealing member 508 is deformed so as to fit on the end edge portions 504, thereby sealing the clearance between the end edge portions 504. At the same time, the adhesive material 512 is tightly adhered to the end edge portions 504, thereby to securely seal the joint portion. Therefore, the roof structure 500 can attain a favorable sealing performance and also prevent a degradation of the sealing performance resulting from thermal deterioration of the sealing member 508 by sunlight or deterioration of the sealing member 508 by repeated freezing and melting due to a snow coverage.

According to the invention, the joint cover member covers the sealing member from the outer side to fit to between the constrained portions of the face members by operating the elastic force and therefore, the sealing member is pressed to the end edge portions of the face members, there is constituted a highly reliable waterproof structure which is difficult to leak water and also waterproof construction operation is facilitated.

At this occasion, there is not an opening or the like of the fin-like sealing member by an ageing deterioration, which is excellent in durability.

According to the invention, further, also the anchor clip is covered by the joint cover and the sealing member and therefore, water is not leaked from the screw hole of the anchor clip.

According to the invention, further, the attaching metal piece is attached to pinch the joint cover member from the outer side, the attached object provided above the face member is attached by the attaching metal piece and therefore, the attached object can easily be attached while ensuring the waterproof structure.

What is claimed is:

1. A waterproof structure of a building, comprising:

at least two face members each having an end edge portion, the at least two face members disposed on an exterior of the building so that the end edge portions are opposed to each other;

a sealing member disposed between the end edge portions; and a joint covering member that is elastically deformable and disposed on an exterior side of the end edge portions; and an anchor clip extending along the end edge portions;

wherein the end edge portions are folded to protrude exteriorly and have constrained portions for narrowing a gap therebetween;

wherein the sealing member is disposed between the end edge portions to close the gap between the end edge portions;

wherein the joint covering member comprises a covering portion and a constricted portion, wherein the covering portion is configured to cover and press the sealing member from an exterior side toward the end edge portions, wherein the constricted portion comprises an upper portion, a lower portion and a folding portion;

wherein the lower portion extends downwardly from a lower edge of the upper portion in a folded manner to extend toward an exterior of the joint covering member, wherein the folding portion is between the upper portion and the lower portion and configured to directly contact the constrained portions to exert an elastic force between the constrained portions to press the end edge portions against the anchor clip, wherein the anchor clip is inserted into the gap being engaged with the end edge portions to be pressed and fitted on a backing member that is disposed on a back side of the face member.

2. The waterproof structure according to claim 1, further comprising: an attaching clip for attaching an attached object to be disposed on the face member;

wherein the attaching clip is attached to pinch the joint cover member from an outer side thereof.

3. The waterproof structure according to claim 1, further comprising: an adhesive material attached on the sealing member, for adhering to the end edge portions.

4. The waterproof structure according to claim 1, wherein a bottom portion of the anchor clip has a width that is equal to or smaller than a size of the gap.

5. A waterproof structure of a building, comprising:

at least two face members each having an end edge portion, the at least two face members disposed on an exterior of the building so that the end edge portions are opposed to each other;

a sealing member disposed between the end edge portions; and a joint covering member that is elastically deformable and disposed on an exterior side of the end edge portions;

an anchor clip extending along the end edge portions; and a cover member having a plate portion and a fitting portion integrated to a lower face of the plate portion, wherein the fitting portion is attached to the constrained portions, wherein the end edge portions are folded to protrude exteriorly and have constrained portions for narrowing a gap therebetween, wherein the sealing member is disposed between the end edge portions to close the gap between the end edge portions, wherein the joint covering member covers and presses the sealing member from an exterior side towards the end edge portions; the joint covering member is adapted to exert an elastic force between the constrained portions to press the end edge portions against the anchor clip, wherein the anchor clip is inserted into the gap being engaged with the end edge portions to be pressed and fitted on a backing member that is disposed on a back side of the face member.

6. The waterproof structure according to claim 5, wherein at least a part of the constrained portions are disposed at an eave side of the building; and the cover member covers an eave of the building.

7. The waterproof structure according to claim 5, wherein at least a part of the constrained portions are disposed on a water upstream side of the building; and the cover member covers the water upstream side of the building.

8. The waterproof structure according to claim 5, wherein the fitting portion includes a cross section having a substantially U-like shape with a narrowed opening.

9. A building, comprising:

a roof;

a supporting member that supports the roof;

at least two face members each having an end edge portion, the at least two face members disposed on an exterior of the building so that the end edge portions are opposed to each other;

a sealing member disposed between the end edge portions; and a joint covering member that is elastically deformable and disposed on an exterior side of the end edge portions; and an anchor clip extending along the end edge portions, wherein the end edge portions are folded to protrude exteriorly and have constrained portions for narrowing a gap therebetween, wherein the sealing member is disposed between the end edge portions to close the gap between the end edge portions, wherein the joint covering member comprises a covering portion and a constricted portion, wherein the covering portion is configured to cover and press the sealing member from an exterior side toward the end edge portions, wherein the constricted portion comprises an upper portion, a lower portion and a folding portion;

wherein the lower portion extends downwardly from a lower edge of the upper portion in a folded manner to extend toward an exterior of the joint covering member, wherein the folding portion is between the upper portion and the lower portion and configured to directly contact the constrained portions to exert an elastic force between the constrained portions to press the end edge portions against the anchor clip, wherein the anchor clip is inserted into the gap being engaged with the end edge portions to be pressed and fitted on a backing member that is disposed on the back side of the face member.

10. The building of claim 9, wherein a bottom portion of the anchor clip has a width that is equal to or smaller than a size of the gap.

* * * * *